US010065283B2

(12) United States Patent
Thysell

(10) Patent No.: US 10,065,283 B2
(45) Date of Patent: Sep. 4, 2018

(54) METHOD AND TOOL FOR MAINTENANCE OF HARD SURFACES, AND A METHOD FOR MANUFACTURING SUCH A TOOL

(75) Inventor: Håkan Thysell, Söderköping (SE)

(73) Assignee: TWISTER CLEANING TECHNOLOGY AB, Söderköping (SE)

( * ) Notice: Subject to any disclaimer, the term of this patent is extended or adjusted under 35 U.S.C. 154(b) by 0 days.

(21) Appl. No.: 11/079,081

(22) Filed: Mar. 15, 2005

(65) Prior Publication Data

US 2006/0211340 A1 Sep. 21, 2006

(51) Int. Cl.

| | |
|---|---|
| ***B24B 7/18*** | (2006.01) |
| ***B24D 13/14*** | (2006.01) |
| ***B24D 11/00*** | (2006.01) |

(52) U.S. Cl.

CPC ..... *B24B 7/186* (2013.01); *B24B 7/18* (2013.01); *B24D 11/00* (2013.01); *B24D 11/005* (2013.01); *B24D 13/14* (2013.01); *B24D 13/142* (2013.01); *B24D 13/147* (2013.01)

USPC ..... 451/41; 451/59; 451/63; 451/353

(58) Field of Classification Search

CPC ..... B24B 7/18; B24B 7/186; B24D 11/00; B24D 11/005; B24D 13/14; B24D 13/142; B24D 13/147

USPC ..... 451/28, 41, 59, 63, 350, 353, 359

See application file for complete search history.

(56) References Cited

U.S. PATENT DOCUMENTS

| | | | |
|---|---|---|---|
| 2,925,593 | A | 2/1960 | Fialkoff |
| 2,958,593 | A | 11/1960 | Hoover et al. |
| 3,020,139 | A | 2/1962 | Camp et al. |
| 3,324,609 | A | 6/1967 | Stein et al. |
| 3,527,001 | A | 9/1970 | Kleemeier et al. |
| 3,537,121 | A | 11/1970 | McAvoy |
| 3,699,672 | A | 10/1972 | Sims |
| 4,078,340 | A | 3/1978 | Klecker et al. |
| 4,227,350 | A | 10/1980 | Fitzer |
| 4,287,685 | A | 9/1981 | Marton |
| 4,437,271 | A | 3/1984 | McAvoy |
| 4,537,802 | A | 8/1985 | Flanagan |
| 4,609,380 | A | 9/1986 | Barnett et al. |
| 4,874,478 | A | 10/1989 | Ishak et al. |

(Continued)

FOREIGN PATENT DOCUMENTS

| | | |
|---|---|---|
| DE | 693 02 736 T2 | 12/1996 |
| EP | 0 536 919 A2 | 4/1993 |

(Continued)

OTHER PUBLICATIONS

Declaration of Louis Charmoille, Technical Manager of 3M France dated Apr. 3, 2007 with 12 Exhibits.

(Continued)

*Primary Examiner* — Eileen Morgan

(74) *Attorney, Agent, or Firm* — Oblon, McClelland, Maier & Neustadt, L.L.P.

(57) ABSTRACT

A method is disclosed for maintaining a hard surface, the method comprising treating the surface with a flexible pad (1), in the presence of abrasive particles, bonded to the pad, on a contact surface between the pad (1) and the hard surface. The abrasive particles comprise diamond particles, and the treating is performed in the absence of an effective amount of crystallization agent on the contact surface.

A tool for use in the method is also provided, as well as a floor surfacing machine comprising such a tool and a method for manufacturing such a tool.

19 Claims, 5 Drawing Sheets

(56) References Cited

U.S. PATENT DOCUMENTS

| | | | | |
|---|---|---|---|---|
| 4,893,439 | A | 1/1990 | McAvoy et al. | |
| 4,893,493 | A | 1/1990 | Jacques et al. | |
| 5,000,761 | A | 3/1991 | Mayton et al. | |
| 5,030,496 | A | 7/1991 | McGurran | |
| 5,054,245 | A | 10/1991 | Coty | |
| 5,249,961 | A | 10/1993 | Hoagland | |
| 5,282,900 | A * | 2/1994 | McDonell et al. | 134/2 |
| 5,429,545 | A | 7/1995 | Meyer | |
| 5,454,751 | A | 10/1995 | Wiand | |
| 5,458,962 | A | 10/1995 | Birch | |
| 5,504,245 | A | 4/1996 | Liang et al. | |
| 5,551,960 | A | 9/1996 | Christianson | |
| 5,573,844 | A | 11/1996 | Donovan et al. | |
| 5,591,239 | A | 1/1997 | Larson et al. | |
| 5,928,070 | A * | 7/1999 | Lux | 451/526 |
| 6,234,886 | B1 | 5/2001 | Rivard et al. | |
| 6,261,164 | B1 | 7/2001 | Rivard et al. | |
| 6,833,014 | B2 | 12/2004 | Welygan et al. | |
| 6,991,527 | B2 * | 1/2006 | Linzell | 451/523 |
| 2003/0172594 | A1 * | 9/2003 | Castro et al. | 51/307 |
| 2004/0029511 | A1 * | 2/2004 | Kincaid et al. | 451/526 |
| 2004/0098923 | A1 * | 5/2004 | Hood et al. | 51/296 |
| 2005/0130568 | A1 * | 6/2005 | Welygan et al. | 451/59 |
| 2005/0233678 | A1 * | 10/2005 | Fritz et al. | 451/28 |

FOREIGN PATENT DOCUMENTS

| | | | |
|---|---|---|---|
| EP | 0 562 919 | A1 | 9/1993 |
| EP | 0 397 374 | B1 | 8/1994 |
| EP | 0 617 099 | A1 | 9/1994 |
| EP | 0 623 424 | A1 | 11/1994 |
| EP | 0 320 146 | | 4/1996 |
| EP | 0 451 944 | B1 | 5/1996 |
| EP | 1 072 715 | A1 | 1/2001 |
| GB | 914315 | | 1/1963 |
| GB | 1 348 526 | | 3/1974 |
| JP | 9-35259 | | 2/1997 |
| JP | 9-509897 | | 10/1997 |
| JP | 2002-209819 | | 7/2002 |
| RU | 2 153 839 | C1 | 8/2000 |
| RU | 2 181 024 | C1 | 4/2002 |
| SU | 1373741 | A1 | 2/1988 |
| WO | WO 95/23539 | | 9/1995 |
| WO | WO 96/21058 | | 7/1996 |
| WO | 03/075734 | A1 | 9/2003 |
| WO | WO 03/075734 | A1 | 9/2003 |
| WO | WO 2005/072440 | A2 | 8/2005 |
| WO | WO 2006/031475 | A1 | 3/2006 |

OTHER PUBLICATIONS

"Abrasives" Kirk-Othmer Encyclopedia of Chemical Technology, Copyright @ 2002 by John Wiley & Sons, Inc., Article Online Posting Date: Dec. 20, 2002, Abstract-pp. 1-Article-pp. 1-25.
Declaration of David Knight, Key Account Manager of 3M United Kingdom PLC dated Feb. 27, 2008 with 1 Exhibit.
Press Release—"3M Adds Scotch-Brite Diamond Floor Pads for Commercial Stone Floor Cleaning", Release date—Feb. 21, 2008—http://news.thomasnet.com/companystory/541162—pp. 4.
EPO Summons regarding Application/Patent No. 05005570.6-2302/1702714 to attend oral proceeding prusuant to Rule 115(1) EPC, Jun. 2, 2009, pp. (13).
Ole Bokinge/OPN, Awa Patent EPO, Munchen, DE, Nov. 3, 2009, Appeal No. T1337/09-3.2.07, pp. (91).
U.S. Appl. No. 12/976,558, filed Dec. 22, 2010, Thysell.
Communication of a notice of opposition dated Apr. 18, 2012 in European Patent Application No. 07101889.9-2302 (with corresponding document).
Communication of a notice of opposition dated Mar. 23, 2012 in European Application No. 05811584.1-2302.
Communication of a notice of opposition dated Mar. 20, 2012 in European Application No. 05811584.1-2302.
Technical Data: 3M Diamond Abrasive & Drive Pad for Marble Floor, TD 123, Commercial Care Laboratory Europe, Jul. 2001, 1 page.
Definition of Linoleum from Wikipedia, http://en.wikipedia.org, 4 pages.
Communication of a notice of opposition, dated Mar. 23, 2012, in European Patent Application No. 05811584.1-2302 (with English-language Translation) (Cover page previously submitted on Apr. 5. 2012).
Office Action dated Mar. 6, 2012 in Japanese Patent Application No. 2008-501169 (with English-language Translation).
Office Action dated Jul. 29, 2011 in Indian Patent Application No. 4591/CHENP/2007 filed Oct. 15, 2007.
Office Action dated Aug. 3, 2011 in Indian Patent Application No. 4392/CHENP/2007 filed Oct. 5, 2007.
Office Action dated Aug. 3, 2011 in Indian Patent Application No. 4590/CHENP/2007 filed Oct. 15, 2007.
U.S. Appl. No. 13/404,605, filed Feb. 24, 2012, Thysell.
Office Action dated May 30, 2012, in Chinese Patent Application No. 200580049743.7 (with English-language Translation).
Office Action dated Feb. 14, 2014 in European Patent Application No. 05 811 584.1.
Office Action dated Mar. 10, 2014 in European Patent Application No. 07 101 889.9.
Summary cleaning project Danderyd Hospital, Evaluation Performed during Nov. 23, 2009 to Jan. 5, 2010, 9 pages (with English-language Translation).
Micro-Mesh Grit Size Conversion Chart, Oct. 18, 2004, 1 page.
Wikipedia Extract, "Glossmeter", Mar. 30, 2012, 4 pages.
Glossmeter: Revision History, Wikipedia, Nov. 5, 2012, 2 pages.
Office Action dated Jul. 25, 2013, in European Patent Application No. 05 811 584.1.
Office Action dated Aug. 12, 2013, in European Patent Application No. 07 101 889.9.
Office Action dated Jul. 24, 2013, in European Patent Application No. 10 184 106.2.
Office Action dated Jul. 24, 2013, in European Patent Application No. 10 184 173.2.
Office Action dated Jul. 24, 2013, in European Patent Application No. 10 184 083.3.

* cited by examiner

METHOD AND TOOL FOR MAINTENANCE OF HARD SURFACES, AND A METHOD FOR MANUFACTURING SUCH A TOOL

TECHNICAL FIELD

The invention relates to a method and a tool for maintenance of hard surfaces, primarily concrete (cement), terrazzo and granite floor surfaces, but also marble or limestone surfaces. The invention particularly relates to a method and a tool for maintenance which is suitable for use on a daily basis to maintain a polished hard floor surface.

BACKGROUND

It is known in connection with cleaning or light polishing of floor surfaces to use a pad in the form of a three-dimensional non-woven web. The pad is usually provided as a circular, disc-shaped body, which is to be disconnectably mounted on a circular carrier plate, which in use is caused to rotate in a plane parallel with the floor surface, such that the pad, when brought into contact with the floor surface, is slightly compressed by the pressure arising between the floor surface and the carrier plate. The carrier plate is usually driven by a motor and may be mounted on a carrier frame, which may be arranged to be pushed or pulled by a walking operator or which may be arranged as a ridable vehicle.

Such pads are generally formed from fibers of an organic material, e.g. polyamide and/or polyester, particularly polyethylene terephtalate. In some cases the fibers also include natural fibers, such as walnut fibers or coconut fibers.

The fibers of the pad are generally interconnected at their mutual points of contact by so-called melt bonding, whereby the fibers are subjected to heat that cause the outer part of the fibers to slightly melt and thereby to bond to each other.

Alternatively, or additionally, the fibers may be interconnected at their mutual points of contact by the pad being impregnated with a polymer resin, hereinafter referred to as a "primary binder".

Production of this type of non-woven pads is well known from e.g. U.S. Pat. No. 3,537,121, U.S. Pat. No. 4,893,439, EP-A-0 397 374, GB-A-1 348 526 and EP-B-0 562 919, and thus does not need to be further elaborated on herein.

U.S. Pat. No. 3,537,121 discloses pads for polishing surfaces of aluminum, plastic, wax and similar surfaces. U.S. Pat. No. 3,537,121 also discloses production of such pads. In U.S. Pat. No. 3,537,121 a binder mixed with abrasive particles is applied to the pad by passing the pad between a pair of squeeze rolls, one of which is partially immersed in a container for a mixture of binder resin and abrasive particles, after which the pad is allowed to cure or dry. Thus, in U.S. Pat. No. 3,537,121 a pad is provided, which is entirely impregnated by the binder and abrasive particles.

U.S. Pat. No. 4,893,439 discloses a pad for polishing floor surfaces or aluminum. The pad consists of fibers of organic material and constitutes a lofty open non-woven structure, and contains a binder binding abrasive particles to the fibers. The pad shown in U.S. Pat. No. 4,893,493 has larger voids than that shown in U.S. Pat. No. 3,537,121, and thereby has an improved ability to absorb dirt, so that it can be used for a longer period. Also the pad disclosed in U.S. Pat. No. 4,893,493 is entirely impregnated by binder and abrasive particles.

EP-A-0 397 374 discloses a pad for floor polishing machines, which also is entirely impregnated by binder and abrasive particles.

Pads of the above type are frequently used for so-called "burnishing", i.e. dry polishing (often on a daily basis) of very lightly worn surfaces at high speed (1500-3000 rpm) and relatively low pressure, with a view to restoring a polished surface. This type of treatment is commonly used for both vinyl and marble floorings. Pads suitable for this purpose are available from 3M™ under the designation "3M™ Floor Pads", and provide no or little effect on very hard floor surfaces, such as terrazzo or concrete, which have been subject to wear for a longer period of time.

EP-B-0 562 919 discloses a non-woven pad of polymer fiber, which is entirely impregnated by a binder comprising a mixture of curable plastic resin and abrasive particles having a particle size of 0.1-30 μm. As examples of curable resins are mentioned phenol resin, acrylic resins, melamine resin and urea resin. Diamond is mentioned as one among several other examples of plausible abrasive particles. However, according to EP-B-0 562 919, the pad disclosed therein is suitable for treatment of marble floor surfaces, and only in combination with crystallization chemicals, which means that treatment must be made in the presence of liquid containing a salt-forming acid.

The pad in EP-B-0 562 919 is also provided by passing a non-woven pad through a nip between two squeeze rolls, one of which being partially immersed in a binder/abrasive particles mixture, such that the binder and abrasive particles, via the surface of the cylinder is distributed in the pad.

Since the pad disclosed in EP-B-0 562 919 is to be used in the presence of crystallization chemicals, the method described in EP-B-0 562 919 actually constitutes a vitrification method, used with a view to improving the stain resistance and durability of a marble floor. This method is not suitable for daily maintenance purposes, since it involves use of special crystallization chemicals, including acids, which are to react with calcium present in the floor surface to form insoluble calcium salts. Such a method is typically used once in connection with the initial preparation of the polished marble floor, and thereafter at intervals of 6-12 months. The method described in EP-B-0 562 919 is thus too complicated for being used on a daily basis.

Pads of the type referred to in EP-B-0 562 919 are sold by 3M® under the designations "3M™ 5200 Brown Stone Renew Pad" and "3M™ 4000 Grey Stone Polish Pad", and are used for treating marble in the presence of crystallization chemicals and at relatively low speeds (below 250 rpm).

The need for crystallization chemicals makes the polishing work more complicated, since the chemicals are to be applied to the surface, possibly followed by removal of excess chemicals, which also contribute to making the polishing work more time consuming. Handling and application of the chemicals also constitute a potential hazard to the environment in general and to the work environment in particular.

It is also known to provide a polished stone or concrete surface by using tools comprising grinding or polishing elements made from a plastic resin mixed with abrasive particles, i.a. diamond particles. Since such elements are fixedly mounted on a usually rotating plate, they do not have the ability to compensate for unevenness in the floor, which may lead to uneven treatment of the floor surface, or to scratching or staining of the floor surface in case such an element is to contact the surface at an excess pressure. Yet another problem is that debris, such as grains of sand, small stones or metal may get stuck in or near the elements and cause scratching of the floor surface. Finally, this type of tools require special machinery capable of applying a higher pressure to the contact surface between the tool and the floor surface.

WO03/075734 discloses a disc-shaped device for cleaning purposes, comprising a nylon scouring material, which is arranged on a rigid disc, whereby grinding elements containing industrial diamonds are placed in recesses in the active scouring surface. A disadvantage with the device disclosed in WO03/07534 is that it does not eliminate the risk of debris getting stuck in or near the grinding elements. Yet another disadvantage is that this tool is complex and therefore more prone to breaking and more difficult and expensive to manufacture.

Hence, there is a need for an improved and simplified method and tool for daily maintenance of hard surfaces. Preferably, the method should be simple to use, e.g. by persons who do not have specialist training in floor surface preparation, and the method should be usable with conventional floor surfacing equipment, e.g. burnishing machines, etc. Also, the tools should be easy to manufacture, not too expensive, and it should be durable.

SUMMARY OF THE INVENTION

It is an object of the invention to provide improved technique, which wholly or partially eliminate the problems with the prior art methods and pads. In particular, it is an object to provide a method of treating a hard surface which is more easy to use and which provides a comparable or better result than the prior art methods.

The invention is based on the idea that abrasive particles in the form of diamond particles provide a polishing effect which is vastly superior to that achievable with those abrasive particles used in the examples shown in e.g. EP-B-0 562 919, and that this polishing effect is so superior as to eliminate the need for crystallization chemicals.

The invention is defined by the appended independent claims. Embodiments are set forth in the dependent claims and in the following description and drawings.

Thus, there is provided a method for maintaining a hard surface, the method comprising treatment of the surface with a flexible pad, in the presence of abrasive particles on a contact surface between the pad and the hard surface. The abrasive particles comprise diamond particles bonded to the pad, and the treating is performed in the absence of an effective amount of crystallization agent on the contact surface.

The term "diamond" is understood to include natural diamond as well as synthetic diamond, and diamond particles being coated with any suitable coating, e.g. silver.

The term "effective amount" is understood as an amount that is sufficient to achieve a measurable gloss improvement as compared to the same treatment using a liquid containing no crystallization agent at all. Amounts known to be effective are about 1-2 liters of crystallization agent (comprising 2-30% by weight of e.g. magnesium hexafluorosilicate) per 50 $m^2$ of floor surface for a single treatment operation. Hence, amounts known to be effective on an ad-hoc basis range from about 0.4 g of magnesium hexafluorosilicate per $m^2$ floor surface. However, diluted crystallization agent, e.g. at a ratio of 1:100 is also known to be effective when used repeatedly, e.g. in connection with daily or weekly maintenance. Hence, amounts known to be effective for maintenance on a regular basis range from about 0.004 g of magnesium hexafluorosilicate per $m^2$ floor surface. It is understood that there are other types of crystallization agents, e.g. zinc hexafluorosilicate, hydrofluoric acid and oxalic acid. The values given above may thus need to be adjusted to apply to the respective type of crystallization agent chosen.

The combination of a flexible pad and diamond particles provides compensation for unevenness in the surface, and distributes the pressure applied to the pad evenly. Also, this combination, through the flexibility of the pad, considerably reduces the risk of the diamonds scratching the surface.

Using diamond particles as abrasive particles when polishing hard stone surfaces provides an effect equal to or better than use of conventional abrasive particles, both in wet and dry conditions. In particular, the use of diamonds enables the crystallization agent to be abolished, thereby eliminating its handling.

The treatment may be performed substantially in the absence of liquid on the contact surface, i.e. during substantially dry conditions; or in the presence of water on the contact surface, i.e. during wet conditions. In particular, the treatment may be performed in the presence of water and a cleaning agent on the contact surface, thereby making it combine excellently with the daily maintenance/cleaning operations.

In one embodiment, the abrasive particles are bonded to the pad by means of a secondary binder. Hence, no abrasives need to be added when treating the floor. Specifically, the abrasive particles may be bonded to the pad only in the vicinity of the contact surface. This is advantageous, since the abrasive particles present in the parts of the pad that are not in contact with the hard surface do not fulfill any function and therefore can be seen as a waste.

The abrasive particles may have an average diameter of 0.1 to 30 μm, preferably between 0.1 and 15 μm and most preferably between 10 and 15 μm.

The abrasive particles may comprise at least one of natural diamond particles, industrial diamond particles and coated diamond particles.

In one embodiment, the pad that is used comprises an open, lofty, three dimensional non-woven web of fibers. Such webs are available at a relatively low cost and in standard sized adapted for the existing surfacing machines.

The pad may have a density of less than 40 $kg/m^3$ preferably 20-35 $kg/m^3$. Thus, the pad comprises a relatively large amount of voids, into which dust, debris and particles may migrate during the treatment. Thus, dust is to a large extent contained in the pad rather than being distributed in the area where the treatment is taking place, eliminating the need for additional dust collecting equipment. Also, by allowing debris to migrate into the pad, the risk for scratching of the surface is reduced.

The method is particularly suitable for use on a floor surface.

The method is particularly applicable where the surface is a stone or stone-like material having a hardness of about 5 moh or more, preferably 6-7 moh. Examples of such surfaces are concrete, terrazzo, granite etc.

The pad, while in contact with the hard surface, may be caused to rotate at a rotational speed of 50-3000 rpm, preferably of 100-1500 rpm.

Furthermore, there is provided a tool for treating a hard surface, the tool comprising a flexible pad having an active treatment surface presenting abrasive particles bonded to the pad. The pad presents a first portion wherein said abrasive particles are present in a first concentration, and a second portion having a second, lower concentration of said abrasive particles, said abrasive particles comprising diamond particles.

In one embodiment, the second portion is substantially free from diamond particles.

Since the abrasive particles present in the parts of the pad that are not in contact with the hard surface do not fulfill any function, pads according to the invention can be manufactured at a lower cost.

The flexibility of the pad eliminates or reduces the harmful effects that diamond abrasive particles could otherwise have on the hard surface. Hence, the tool may be used for any hard surface, such as surfaces of wood, laminate, marble, granite, concrete, terrazzo, etc. However, the tool is particularly effective for hard stone or stone-like surfaces, such as granite, concrete, terrazzo, etc.

In one embodiment, the pad consists of a disc-shaped body having a thickness and a first surface, wherein said abrasive particles are present on said first surface and down to a depth from said first surface, which depth is less than said thickness, such that said first portion is at said first surface and said second portion is at a second surface, opposite said first surface. By leaving the second surface free from abrasive material and binder, the attachment of the pad to a Velcro hook connector on a carrier plate is facilitated.

In a second embodiment, the pad consists of a disc-shaped body having a thickness and a first surface, wherein said abrasive particles are present over less than the entire first surface, such that said first and second portions are situated adjacent each other at said first surface. This second embodiment facilitates migration of dust and debris into the pad.

In one embodiment, the pad comprises an open, lofty, three dimensional non-woven web, including a plurality of fibers, which are adhered to each other at their points of mutual contact.

The abrasive particles may be bonded to the fibers of the pad by a secondary binder. Hence, the bonding of the fibers of the pad does not in any way need to be negatively affected by the fact that the abrasive particles are only present at the contact surface.

As non-limiting examples, the secondary binder may be selected from a group consisting of phenol resin, melamine resin, urea resin and epoxy resin.

In one embodiment, the secondary binder forms a plurality of distinct droplets having a maximum diameter which is smaller than an average length between two points of mutual contact of a fiber. Thus, the fibers are not entirely coated by the binder resin, facilitating further the migration of dust and debris into the pad.

The pad may further comprise second abrasive particles selected from a group consisting of graphite, tin oxide, silicon carbide and aluminum oxide.

The pad is preferably provided in the shape of a circular disc having a diameter between 30 and 100 cm and an uncompressed thickness between 1 and 5 cm.

Finally, there is provided a method for manufacturing a pad for treating a hard surface. The method comprises: providing a pad, and applying, on a first surface of the pad, a mixture of a binder and abrasive particles including diamond, such that said pad presents a first portion wherein said abrasive particles are present in a first concentration and a second portion, having a second, lower concentration of said abrasive particles. In one embodiment, the second portion is substantially free from said abrasive particles. The abrasive particles may be provided to the first surface by spraying, rolling or dipping.

DESCRIPTION OF EMBODIMENTS

The description will first focus on a tool suitable for use in the method for maintenance of hard surfaces, subsequently on the method for manufacturing the tool, and finally on the use of the tool for maintenance of a hard surface.

Figure 1A:
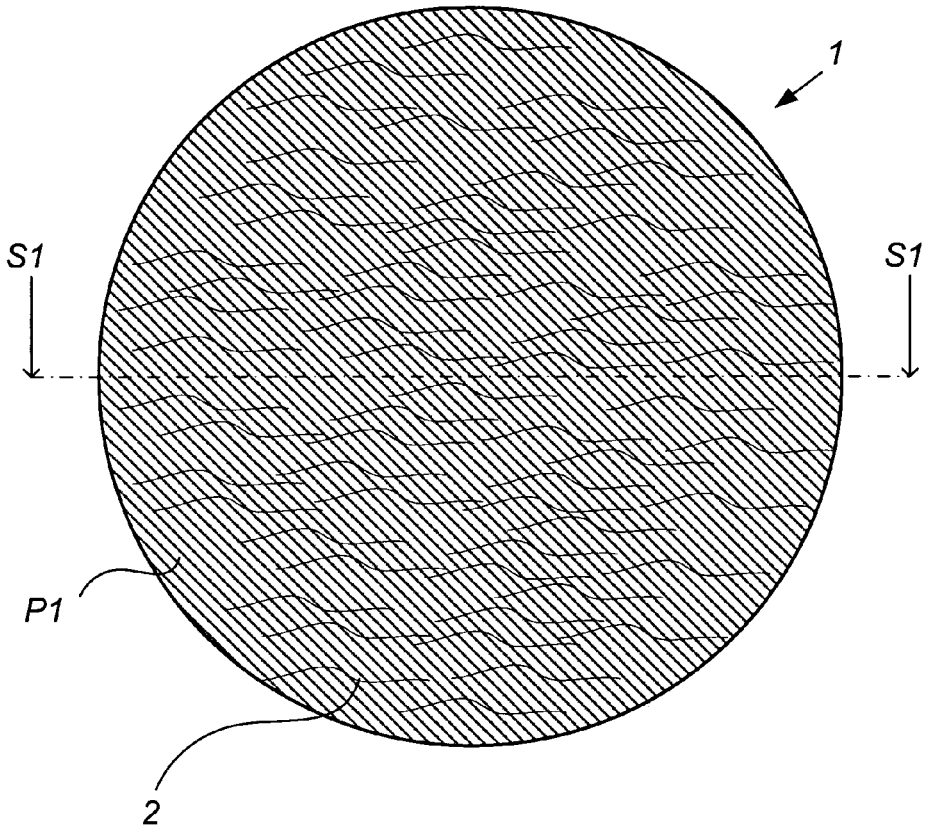
FIGS. 1*a*-1*b* show a pad according to a first embodiment.

Referring to FIG. 1*a*, there is shown a pad 1 made up from an open, lofty three dimensional non-woven web of fibers 2. A first surface of the pad 1 has a portion P1 presenting abrasive particles bonded to the web by means of a secondary binder, i.e. a binder having as a main purpose to bond fibers to the web. The pad 1 is circular in shape.

Figure 1B:
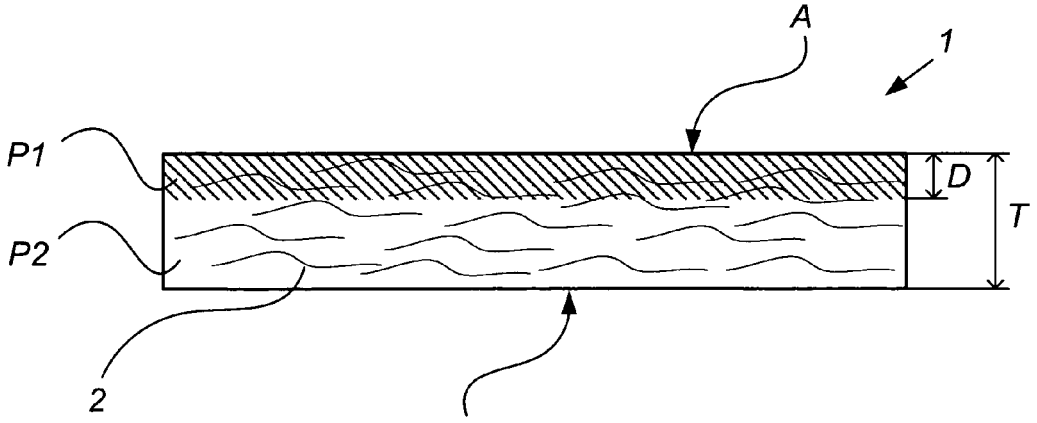

Referring to FIG. 1*b*, a cross section along the line S1-S2 in FIG. 1*a* is shown. As is indicated in FIG. 1*b*, the portion P1 presenting the abrasive particles is present at the first surface A and to a depth D, which is less than the thickness T of the pad 1. Hence, at the second surface B there is a portion P2, which is substantially free from the abrasive particles and the secondary binder.

When referring to "portions", it is to be understood as a portions of the macrostructure of the pad 1 and not portions of the individual fibers.

Figure 2A:
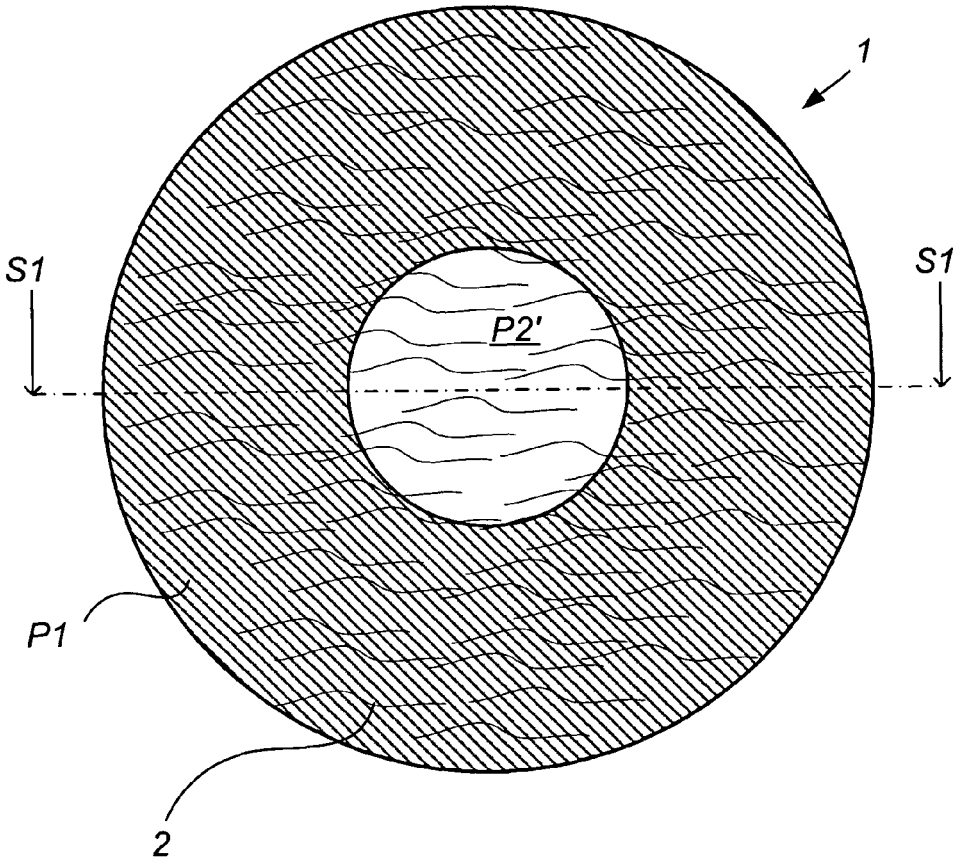
FIGS. 2*a*-2*b* show a pad according to a second embodiment.
Figure 2B:
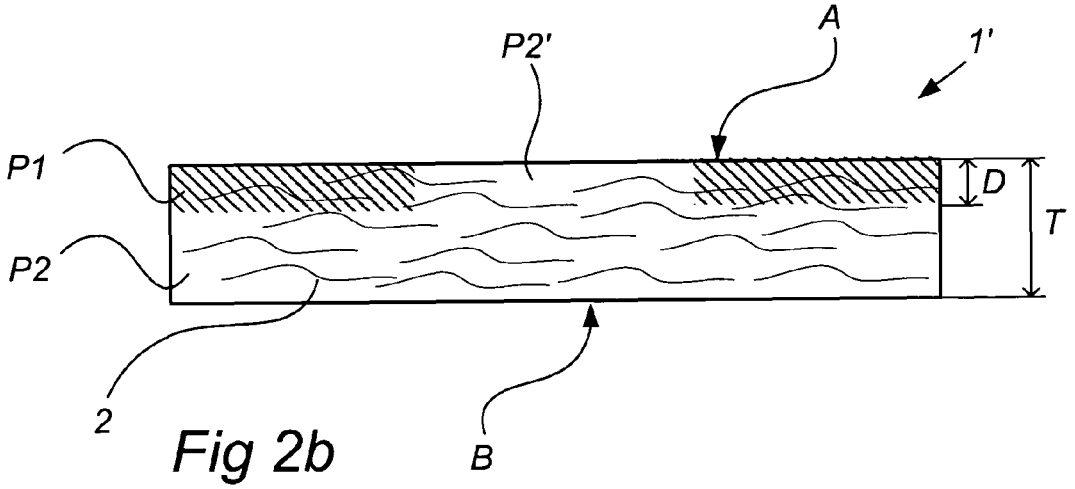

Referring to FIGS. 2*a* and 2*b*, there is shown a similar pad 1, the difference being that there is a portion P2' also at the first surface A, which portion P2' is substantially free from the abrasive particles and the secondary binder.

In both embodiments, the abrasive particles are present throughout the secondary binder, and the fibers are bonded to each other by a primary binder and/or by being melt-bonded.

A description of the preparation of a pad 1 according to the embodiment discussed with reference to FIGS. 1*a* and 1*b* will now be given.

Figure 3A:
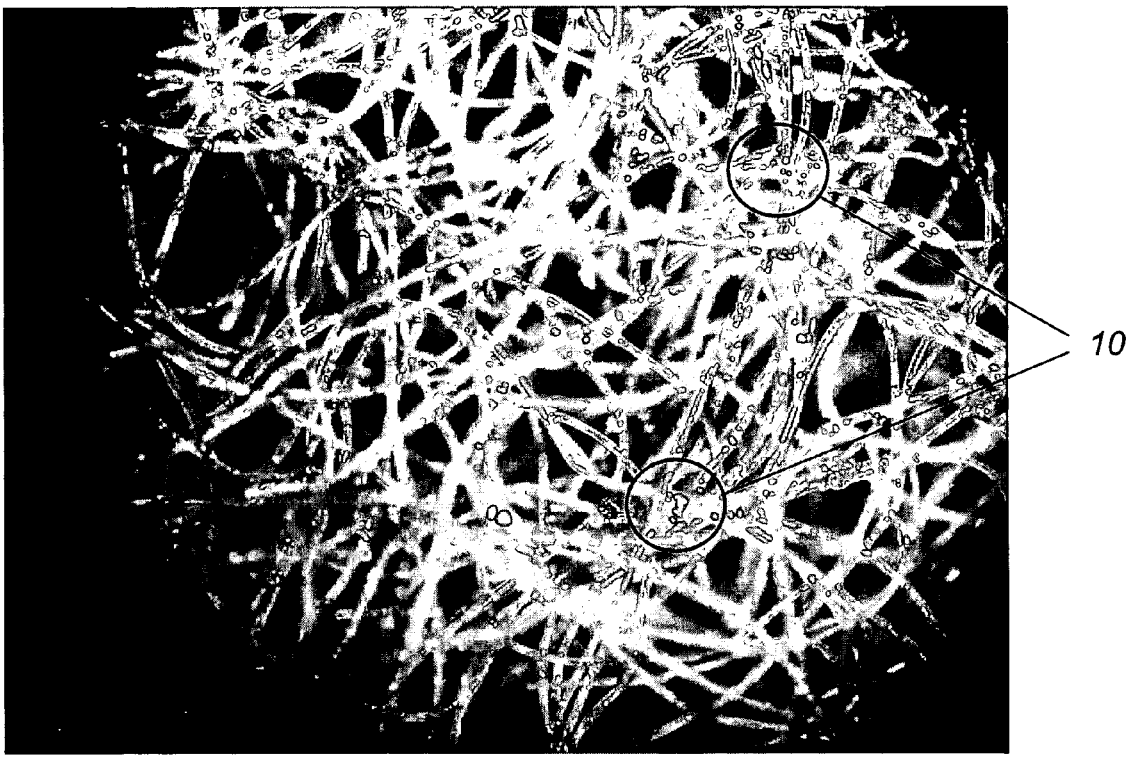
FIGS. 3*a*-3*b* show enlarged photographs of a pad according to the present invention, before and after the binder and abrasive particles have been applied.

As a starting material, circular, disc shaped Glit/Microtron® Tan Floor Polishing Pad having a diameter of 20 inches (51 cm), a thickness of 28 mm and a weight of 157 grams was used. Such pads are available from Glit/Microtron, Wrens, Ga., USA. The starting density of the pad was thereby 27 kg/m$^3$. FIG. 3*a* is a microscope photograph showing the pad prior to application of the polymer resin/abrasive particles. From FIG. 3*a*, it can be seen that the fibers constituting the pad are held together at their points 10 of mutual contact by a primary polymer resin. The pad is flexible and resilient and comprises polyester and nylon fibers.

A homogenous polymer resin mixture was prepared, consisting of 200 g PA resin 52-68 phenol resin (available from Perstorp AB, Perstorp, Sweden), 100 g of T-RÖD® ethanol (available from Alfort & Cronholm AB, Bromma, Sweden) and 20 g of LANDS LS600F 4-8 μm diamond particles (available from Lands Superabrasives, Co., New York, N.Y., USA). Just before application of the mixture, 60 g of 65% p-toluene sulfonic acid (PTS) was added as a hardener.

The resin mixture was sprayed onto a first one A of the surfaces of the polishing pad, using a standard-type compressed air spray gun (normally used for spraying paint). The pad with the uncured resin thereafter weighed 173 grams. Subsequently, the pad was placed in a hot air oven at approximately 120° C. for approximately 20 minutes.

Figure 3B:
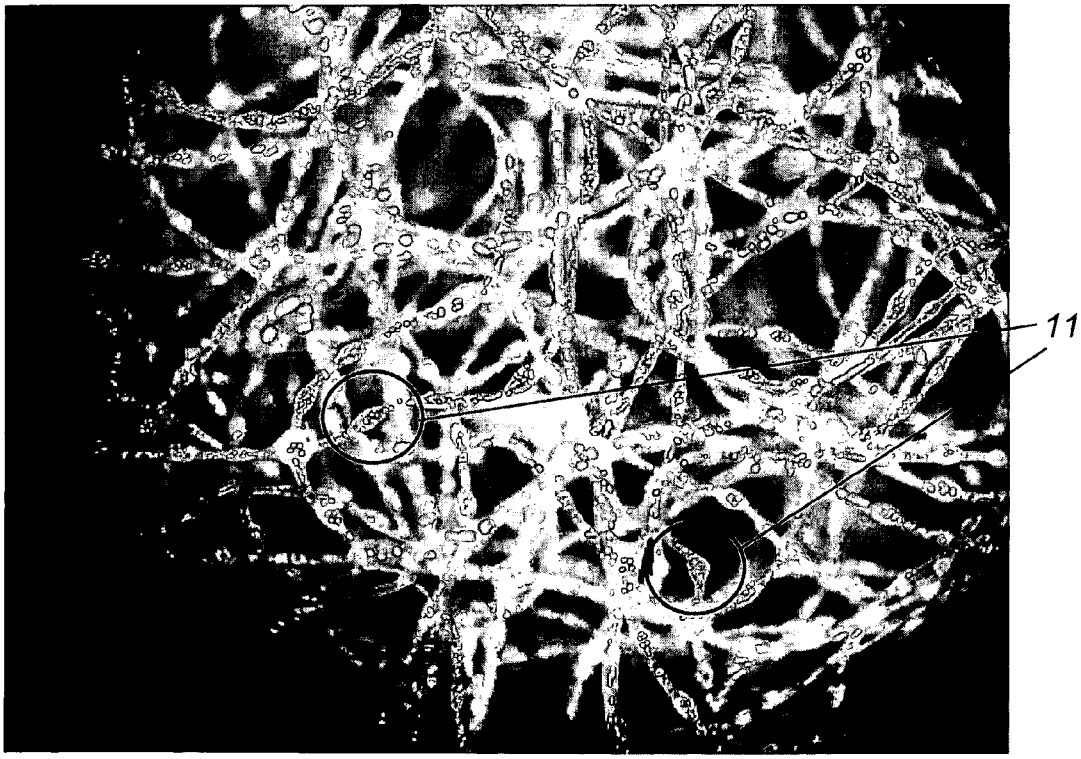
Figures 4A, 4B:
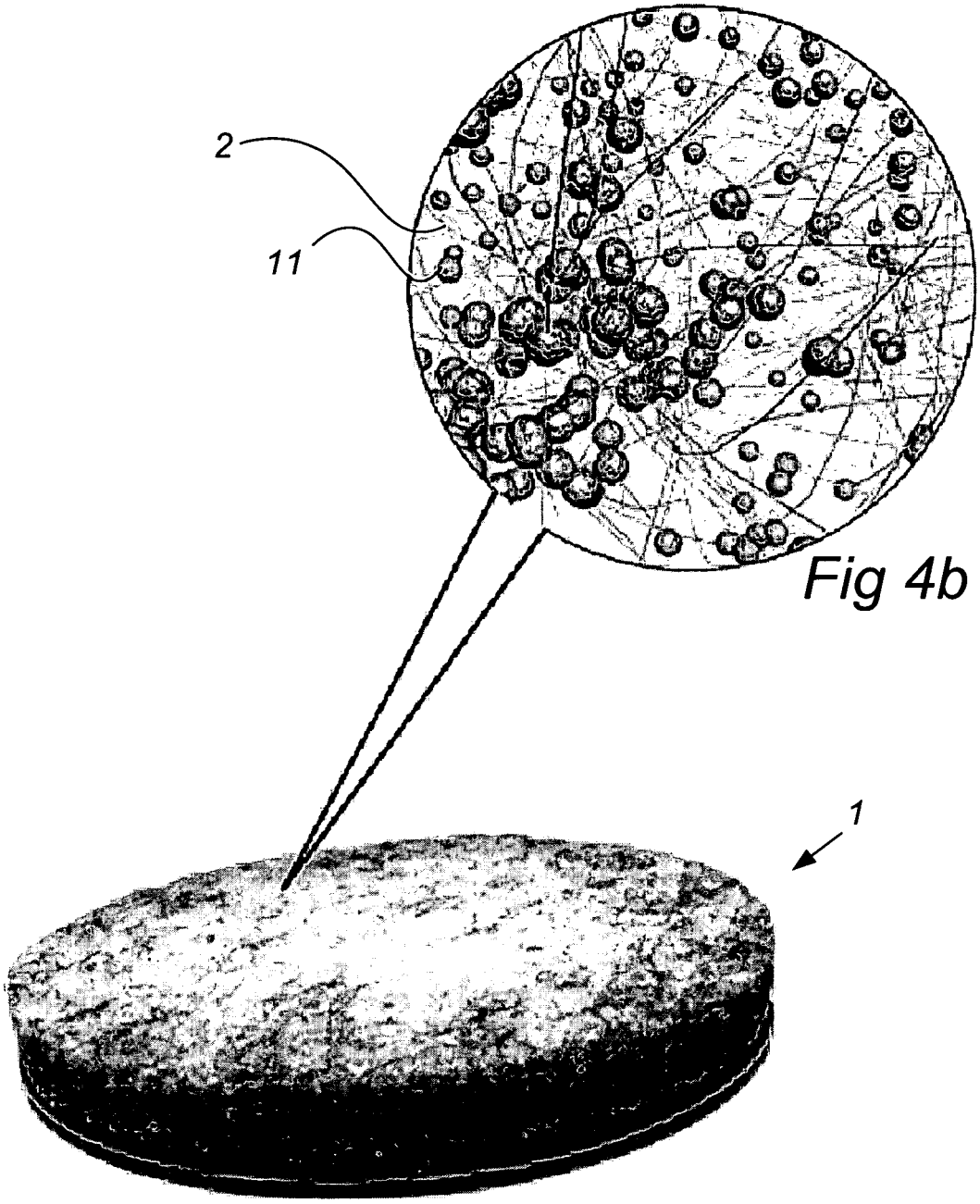
FIGS. 4*a*-4*b* show a diagram of a pad according to the first embodiment, and an enlargement of a portion of the pad.

The pad has now assumed the appearance that can be seen from FIG. 3*b*, which is a microscope photograph. Globules or droplets 11 of the resin/particle mixture are formed along each fiber, also between the fibers' points of mutual contact. The droplets are so distributed that the fibers to which they are adhered are not entirely covered. A more clear illustration of this is found in FIGS. 4*a*-4*b*, which show a pad as described above with reference to FIGS. 1*a*-1*b*, and an enlargement of a portion of that pad (FIG. 4*b*), wherein droplets 11 of binder/particle mixture are attached to the fibers.

In order to evaluate the performance of the pad produced as described above, comparative tests were carried out in order to evaluate two different 20 inch (51 cm) pads, prepared as described above: a first one, referred to as "yellow", having 7-12 μm silver coated diamond particles, and a second one, referred to as "green", having 3-6 μm normal diamond particles. As a reference, two different commercially available pads were used: a 20 inch (51 cm) 3M™ 5200 Brown Stone Renew Pad and a 20 inch (51 cm) 3M™ 4000 Grey Stone Polish Pad were used, both available from 3M, St. Paul, Minn., USA.

The tests were made on two different surface types: Kolmården marble (marble from the Kolmården area outside Norrköping, Sweden) and K40 concrete. Each test was carried out on a surface of about 1 $m^2$, using a Coor & Kleever Crystallizer 1250KG floor surfacing machine (available from Coor & Kleever, S.A., Barcelona, Spain) having a single carrier plate adapted for receiving a 20 inch floor pad and rotating at about 175 rpm. The test included polishing the surface for about 1 minute/$m^2$. The surface gloss was measured at several spots on the area before and after each treatment using a Sanwal/Cenma IG-310 Glosschecker. The gloss value in the tables below constitute the average value for each area. High gloss is rated 80-90°. Semi gloss is rated 50-75°. Satin is rated 30-45°. Rubbed effect is rated 20-25°. Flat sheen is rated 5-15°.

Each surface was tested both dry and using water as a lubricant. Additionally, the concrete surface was tested using Coor Rosa/K-2 crystallizer (available from Coor & Kleever S.A., Barcelona, Spain) as lubricant, i.e. the crystallization chemical mentioned in EP-B-0 562 919 as comprising magnesium hexafluourosilicate as crystallization agent.

When testing the 3M™ pads, each surface portion was first treated with the brown pad and subsequently with the gray pad.

TABLE 1

Tests performed with water as lubricant on Kolmården marble

| | Pad | | |
|---|---|---|---|
| | Brown | Gray | Green |
| Initial gloss | 17 | 17 | 10 |
| Liquid | Water | Water | Water |
| Final gloss | 17 | 35 | 30 |

TABLE 2

Tests performed without lubricant on Kolmården marble

| | Pad | | |
|---|---|---|---|
| | Brown | Gray | Green |
| Initial gloss | 20 | 25 | 28 |
| Liquid | No | No | No |
| Final gloss | 25 | 30 | 50 |

From tables 1 and 2, it can be concluded that on marble, which is a relatively soft stone having a hardness of about 3-5 moh, and using water as a lubricant, the 3M™ pad combination (brown and gray) provide a slightly better effect, although both the gray and the green pads achieved values falling within the "satin" range. However, during dry conditions, the green pad achieved a remarkable improvement, reaching the semi-gloss range.

TABLE 3

Tests performed with water as lubricant on K40 concrete

| | Pad | | | |
|---|---|---|---|---|
| | Brown | Gray | Yellow | Green |
| Initial gloss | 30 | 29 | 24 | 35 |
| Liquid | Water | Water | Water | Water |
| Final gloss | 29 | 29 | 35 | 46 |

TABLE 4

Tests performed without lubricant on K40 concrete

| | Pad | | | |
|---|---|---|---|---|
| | Brown | Gray | Yellow | Green |
| Initial gloss | 29 | 34 | 30 | 48 |
| Liquid | No | No | No | No |
| Final gloss | 34 | 35 | 48 | 58 |

From Tables 3 and 4, it is noted that in wet conditions and on K40 concrete, having a hardness of about 6-7 moh, the combination of brown and gray pads did not provide any measurable improvement at all, whereas the combination of yellow and green pads provided a distinct improvement. In dry conditions, a small improvement was noted for the surface treated with the combination of brown and gray pads, whereas a major improvement was noted for the surface treated by the combination of yellow and green pads.

TABLE 5

Tests performed with Coor Rosa/K-2 crystallizer as lubricant on K40 concrete

| | Pad | |
|---|---|---|
| | Gray | Green |
| Initial gloss | 41 | 35 |
| Liquid | VMC-Pink | VMC-Pink |
| Final gloss | 45 | 51 |

From table 5, it is noted that some effect is achievable with a gray pad using Coor Rosa/K-2 crystallizer as lubricant on K40 concrete, and that a somewhat better effect is achievable with the green pad using Coor Rosa/K-2 crystallizer as lubricant.

All in all, it is concluded that the pad according to the invention provides a noticeable improvement as compared with the prior art. The improvement is particularly noticeable during dry conditions and on concrete.

Figure 5:
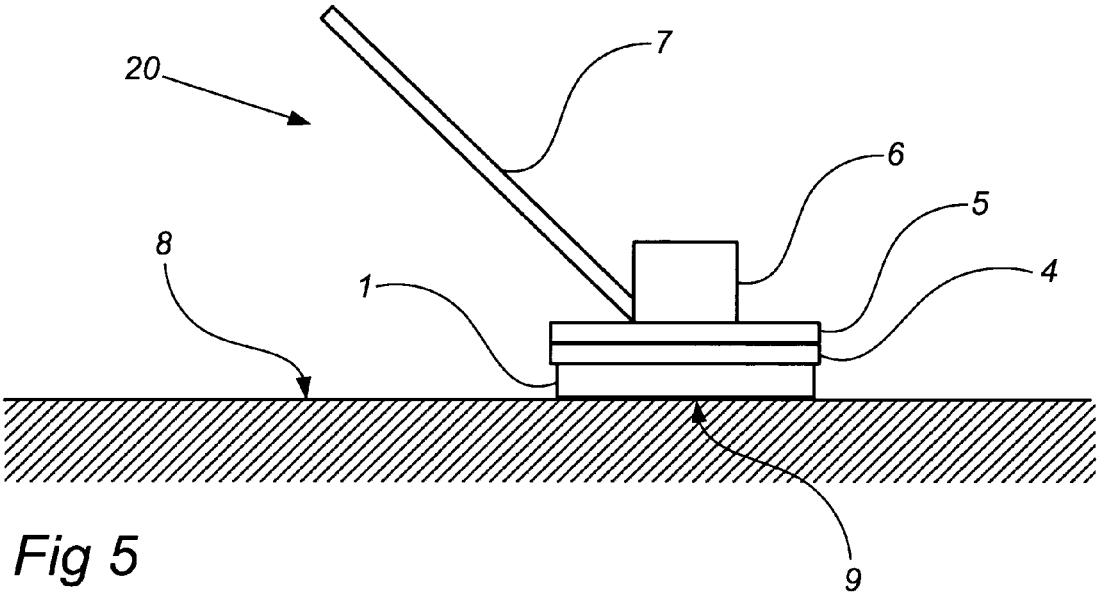
FIG. 5 is a schematic sectional view of a floor surfacing machine on which a pad according to the invention is mounted.

FIG. 5 is a sectional view of a floor surfacing machine 20 on which a pad 1 according to the invention is mounted so as to define a contact surface 9 with the hard surface 8, which in this example is a floor surface. The pad 1 is mounted on a driven, rotatable carrier plate 4, which is typically journalled in bearings and thus rotatable relative to a machine body 5, on which a motor unit 6 is arranged. In this embodiment, the machine has a handle 7, and is thus adapted for being held/pushed/-pulled by a walking operator. It is recognized that in other embodiments the floor surfacing machine 20 may be e.g. a ridable vehicle fitted with a carrier plate 4 that is adapted for receiving the pad 1.

The pad 1 and method described above can be used for everyday cleaning/maintenance of polished hard surfaces, such as stone, concrete or terrazzo floor surfaces using a floor surfacing machine such as a scrubber/dryer combination machine, e.g. the Nilfisk CR1300; a single disc floor maintenance machines (low speed or high speed), e.g. the Nilfisk 510B or 545; a burnisher, e.g. the Nilfisk SDH5120, BHS5120 or BHS7014, all of which are available from Nilfisk-Advance, Stockholm, Sweden.

The treatment of the floor surface is typically performed by causing the pad, when in contact with the floor surface, to rotate in a plane parallel with the floor surface. Typical rotational speeds are from 50 rpm to 3000 rpm. However, lower or higher rotational speeds are not excluded.

As is clear from the above, a first embodiment of the pad according to the invention comprises an open, lofty, three dimensional non-woven web, including a plurality of fibers, which are adhered to each other at their points of mutual contact by means of a primary binder, and in which abrasive particles are mixed with a secondary binder and applied only to a first surface of the pad, such that the pad is only partially impregnated by the binder/particle mixture. Alternatively, or additionally, the fibers may be melt-bonded to each other.

In a second embodiment of the pad, binder/particle mixture is only applied to parts of said first surface. This can be achieved by masking those parts of the surface to which the binder/particle mixture should not be applied.

In a third embodiment, the pad is entirely impregnated with the binder/particle mixture, e.g. by using such squeeze rollers as are described in EP-B-0 562 919. In a variant of this embodiment, a relatively thin impregnated woven or non-woven pad is attached to a thicker carrier pad in order to provide the flexibility. According to variants of this embodiment, a substantially two-dimensional woven or non-woven web is attached to a thicker carrier pad.

In a fourth embodiment, a three dimensionally woven or knitted pad may be used, whereby the binder/particle mixture is applied as described above.

In a fifth embodiment, the abrasive particles are present in the material of the pad. In a first alternative, the pad is a non-woven fiber pad substantially as described above, with the diamond particles included in the fiber material. In a second alternative, the pad is a polymer foam pad with the diamond particles included in the foamed polymer material.

In a sixth embodiment, the pad is a polymer foam pad, to a surface of which a binder/particle mixture is applied as described above.

The invention is not limited to the use of phenol resin. Other examples of suitable resins are melamine, urea, epoxy and polyester resins.

Furthermore, the hardener may be selected from any hardener suitable for the type of resin selected. Also it is possible not to include the hardener, e.g. by allowing the pad to cure at a higher temperature and/or for a longer period of time.

Also, the solvent (ethanol was used in the example) is provided merely to reduce the viscosity of the mixture and thereby to facilitate spraying thereof. Any suitable solvent may be used, and the solvent may also be excluded, provided that the method of application so allows.

The abrasive particles preferably include diamond. However, floor treatment pads may be produced according to the principles set forth above using other types of abrasive particles, or combinations thereof, as well, e.g. those mentioned in EP-B-0 562 919. In particular silver coated diamond particles have proven to provide good results as well. Naturally, the diamond particles may be combined with other types of abrasive particles.

It is understood that the pad 1 having secondary binder and abrasive particles as described above may be attached to a disc or plate having an arbitrary connector for being connected to a carrier plate of the surfacing machine, or that the pad may be directly connectable to the surfacing machine by means of a Velcro-type hook arrangement provided on the carrier plate, the hooks of which engage the fibers of the pad 1. Hence, the maintenance tool may be composed of the pad with the primary binder, the secondary binder and the abrasive particles, possibly with the addition of dyes or printed areas providing information on the type of pad, manufacturer, trademark etc.

Alternatively, or additionally, the pad may be provided with a backing layer.

A pad 1 for polishing a hard surface may be provided as described above. Such a pad may, in one embodiment comprise diamond particles having an average size of about 0.1-80 μm. In preferred embodiments, the average particle size may be about 0.1-30 μm, about 0.1-20 μm or about 0.1-15 μm.

According to another embodiment, a grinding pad may be provided as described above, but comprising diamond particles of a different average particle size. For example, a grinding pad comprising diamond particles having an average size of about 80-800 μm may be provided, preferably 80-600 μm and more preferably 80-300 μm.

The invention claimed is:

1. A method of maintaining a gloss on an uncoated surface of a stone material, including marble, terrazzo, or polished concrete, at or above an initial value, the method comprising:

providing a flexible pad of an open, lofty, three dimensional nonwoven web of fibers having diamond particles bonded thereto on a contact surface and dispersed within the flexible pad, the diamond particles having an average diameter of 3 to 6 μm;

treating the uncoated surface of the stone material by applying pressure and relative motion between the contact surface of the flexible pad and the uncoated surface of the stone material, in the absence of an effective amount of crystallization agent; and repeating the treating step as part of a regular daily maintenance routine to maintain the gloss at or above the initial value.

2. The method as claimed in claim 1, wherein the step of treating is performed substantially in the absence of liquid.

3. The method as claimed in claim 1, wherein the step of treating is performed in the presence of water.

4. The method as claimed in claim 3, wherein the step of treating is performed in the presence of water and a cleaning agent.

5. The method as claimed in claim 1, wherein the flexible pad has diamond particles bonded thereto by a secondary binder.

6. The method as claimed in claim 1, wherein the flexible pad has diamond particles bonded thereto only in a vicinity of the contact surface.

7. The method as claimed claim 1, wherein the flexible pad has diamond particles comprising at least one of natural diamond particles, industrial diamond particles and coated diamond particles.

8. The method as claimed in claim 1, wherein the flexible pad has a density of less than 40 $kg/m^3$.

9. The method as claimed in claim 8, wherein the flexible pad has a density of 20-35 $kg/m^3$.

10. The method as claimed in claim 1, wherein the stone material has a hardness of about 6-7 moh.

11. The method as claimed in claim 1, wherein said flexible pad, while in contact with the surface of stone material, is caused to rotate at a rotational speed of approximately 50-3000 rpm.

12. The method as claimed in claim 11, wherein said flexible pad, while in contact with the surface of stone material, is caused to rotate at a rotational speed of approximately 100-1500 rpm.

13. The method according to claim 1, wherein the treating is performed at least once daily.

14. The method according to claim 1, wherein the diamond particles are dispersed within the open, lofty, three dimensional nonwoven web of fibers to a predetermined depth from the contact surface of the flexible pad.

15. The method according to claim 1, wherein the stone material has a hardness of at least 5 moh.

16. The method according to claim 1, wherein the treating is performed by a scrubber/dryer combination floor surfacing machine.

17. The method according to claim 1, wherein the treating is performed by a ridable floor surfacing machine.

18. The method according to claim 1, wherein the treating is performed on a daily basis.

19. The method according to claim 1, wherein the stone material is concrete.

* * * * *